US011245200B1

(12) United States Patent
Rmili et al.

(10) Patent No.: US 11,245,200 B1
(45) Date of Patent: Feb. 8, 2022

(54) SUBSTRATE INTEGRATED WAVEGUIDE HAVING SPACE APART RADIATING ELEMENTS FORMED ON A SUBSTRATE AND A SUPERSTRATE INCLUDING PAIRS OF WINGS AND A RECONFIGURABLE METASURFACE FOR BEAM SCANNING THE RADIATING ELEMENTS

(71) Applicant: King Abdulaziz University, Jeddah (SA)

(72) Inventors: Hatem Malek Rmili, Jeddah (SA); Abdulah Jeza Aljohani, Jeddah (SA); Abdelkhalek Nasri, Jeddah (SA); Raj Mittra, Jeddah (SA)

(73) Assignee: King Abdulaziz University, Jeddah (SA)

( * ) Notice: Subject to any disclaimer, the term of this patent is extended or adjusted under 35 U.S.C. 154(b) by 1 day.

(21) Appl. No.: 17/194,550

(22) Filed: Mar. 8, 2021

(51) Int. Cl.

| | |
|---|---|
| ***H01Q 21/00*** | (2006.01) |
| ***H01P 3/12*** | (2006.01) |
| ***H01Q 3/34*** | (2006.01) |
| ***H01P 9/00*** | (2006.01) |
| ***H01P 1/18*** | (2006.01) |

(52) U.S. Cl.
CPC ..... *H01Q 21/0068* (2013.01); *H01P 1/182* (2013.01); *H01P 3/121* (2013.01); *H01P 9/006* (2013.01); *H01Q 3/34* (2013.01)

(58) Field of Classification Search
CPC ..... H01P 1/182; H01P 3/121; H01P 9/006; H01Q 3/34; H01Q 21/0068
USPC ..... 333/157, 237
See application file for complete search history.

(56) References Cited

U.S. PATENT DOCUMENTS 8,471,776 B2 * 6/2013 Das ..... H01Q 21/061 343/770
9,831,565 B2 * 11/2017 Tageman et al. ..... H01Q 9/045

* cited by examiner

*Primary Examiner* — Benny T Lee
(74) *Attorney, Agent, or Firm* — W&C IP

(57) ABSTRACT

The suprastructure over a substrate integrated waveguide (SIW) can provide for beam scanning utilizing a reconfigurable metasurface. The reconfigurable metasurface will have a plurality of PIN diode arrays that can be turned ON and OFF. In one design, the length of the reconfigurable metasurface is effectively enlarged or reduced in size to achieve beam scanning. In another design the tilt angle of the reconfigurable metasurface is adjusted to achieve beam scanning. The suprastructure also can be modified with metallic offset wings, where two or more pairs of offset wing can form a horn shaped element. The presence of the wings or horn, as well as control of the size and number of the wings can improve the gain of the SIW. These two suprastructure improvements may be used in combination, and they may be used over classical slotted SIWs or over an SIW with curved sections between consecutive slots.

7 Claims, 4 Drawing Sheets

SUBSTRATE INTEGRATED WAVEGUIDE HAVING SPACE APART RADIATING ELEMENTS FORMED ON A SUBSTRATE AND A SUPERSTRATE INCLUDING PAIRS OF WINGS AND A RECONFIGURABLE METASURFACE FOR BEAM SCANNING THE RADIATING ELEMENTS

BACKGROUND

Scanning array antennas are key components of microwave systems for wireless communication, satellite communication and 5G applications. Conventional approaches to scanning a beam have included using a phase shifter that introduces a phase taper in an array excitation to direct the beam in different directions depending on the phase shift between elements. Some of these approaches have included a slot array design utilizing a substrate integrated waveguide technology for beam-tilting and 5G applications, a near-field focusing arrangement for dynamically reconfiguring a holographic metasurface aperture, and the use of liquid metal parasitics. J. Yu, W. Jiang, and Sh. Gong, "Low RCS Beam-steering Antenna Based on Reconfigurable Phase Gradient Metasurface," IEEE Antennas and Wireless Propagation Letters. Vol. 18, no. 10, pp. 2016-2020, October 2019, described utilizing reconfigurable phase gradient metasurfaces for beam scanning. Despite the fact that the development of scanned arrays is a mature field, there is still a continuing interest in developing novel array designs, especially at millimeter waves, that are both low-loss and low-cost.

SUMMARY OF THE INVENTION

One aspect of the invention is to provide a novel design for a beam-scanning array which performs the scan without employing any phase shifters. Rather, scanning is achieved by using reconfigurable metasurfaces in a new way.

Another aspect of the invention is to provide a novel design for gain enhancement for use with an SIW waveguide.

Still another aspect of the invention is to provide a superstrate for beam scanning and/or gain enhancement for use on SIW waveguide which is not bulky, highly lossy, and/or expensive to fabricate.

In one embodiment, low-cost two-dimensional (2D) reconfigurable metasurfaces are used as tilted superstrates, and are placed above a slotted array in an SIW waveguide to provide the array with a desired scan capability. The gain of the array is enhanced by attaching two wings to the top wall of the SIW waveguide. The wings are angled apart with a spacing therebetween. Radiating elements which extend within the SIW waveguide are oriented in the spacing.

The reconfigurable metasurface of the superstrate is tilted. In one embodiment, the length of the titled reconfigurable metasurface is varied. This is accomplished by changing the state of the PIN diodes, thereby changing the panel length. In turn, this allows for changing the beam direction. In another embodiment, a plurality of panels with different tilt angles is employed, and the PIN diode state is selectively ON for one panel at a time. In both embodiments, reconfigurability of the superstrate, i.e., the reconfigurable metasurface, is achieved by using switchable PIN diodes. The system is relatively low cost and has good performance.

In another embodiment, the gain of the antenna is enhanced by adding two additional wings above the array of radiating elements in the superstrate. The first and second pair of wings are oriented at right angles to one another to form a horn-like configuration with the radiating elements positioned in a spacing between the wings of the first pair of wings and a spacing between the wings of the second pair of wings.

In yet another embodiment, a substrate includes an SIW waveguide with a plurality of curved sections which passes through the substrate from the wave entry port to the wave exit port. The plurality of curved sections forms a serpentine path of curves in a first direction followed by curves in a second direction which are opposite the first direction. The plurality of spaced apart radiating elements are positioned between curves in the first direction and curves in the second direction. A horn-like formation is positioned in a superstrate over the substrate with the radiating elements being positioned in an opening between two sets of metallic wings, where the sets of wings are perpendicular to one another.

DETAILED DESCRIPTION OF THE INVENTION

Figure 3:
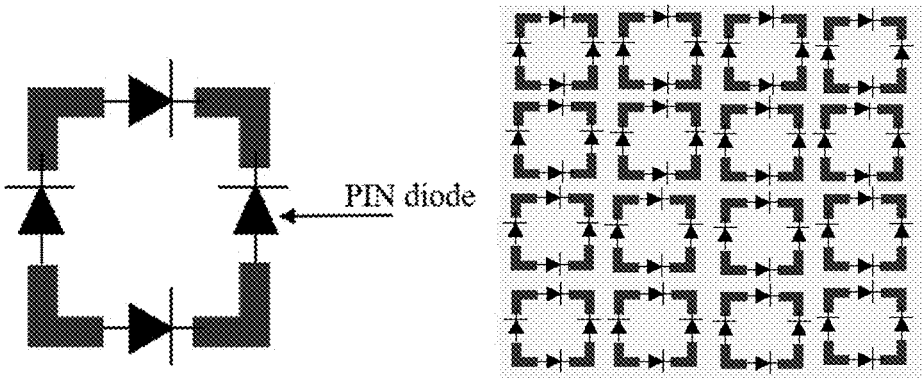
FIG. 3 is a schematic showing a single unit cell design for the reconfigurable metasurface and a portion of the reconfigurable metasurface.

One focus of this invention involves techniques to scan the beam of an array without using phase shifters. The techniques described utilize reconfigurable metasurface superstrates which are placed on an array formed with a substrate integrated waveguide (an SIW array). A typical metasurface comprises an array of periodic elements such as metallic split rings, printed on a substrate, as shown by example in FIG. 3. The metasurface is designed to allow the incident electromagnetic waves to transmit through when the PIN diodes are "OFF". However, the metal surface becomes essentially totally reflecting when these PIN diodes are switched "ON". In some embodiments of the invention, the length of the reconfigurable metasurface is varied to realize the beaming scanning feature, while in other embodiments of the invention, the tilt angle of the reconfigurable metasurface is varied.

Another focus of this invention is a structural configuration for enhancing the gain of the antenna. This structural configuration is also built on top of the SIW array, and is in the form of wings which create a "horn" shape extending above the array.

In operation, the wings enhance the gain, but they do not contribute to the beam scan, while the metasurface and operation of the PIN diodes allow for beam scanning, but do not adjust the gain.

Figure 1:
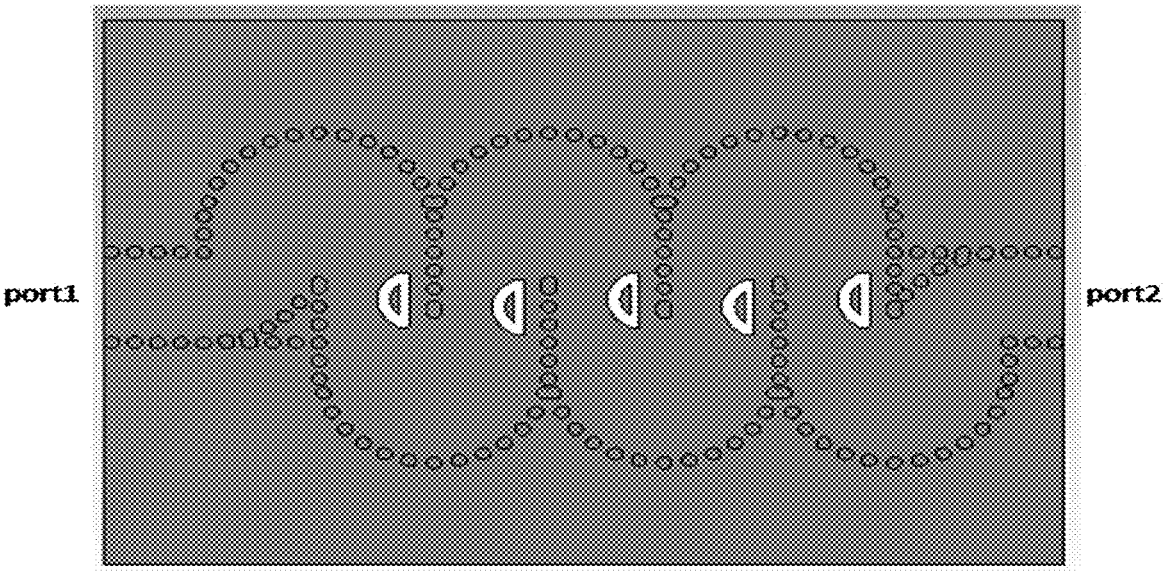
FIG. 1 is an exemplary slotted array with a curved SIW waveguide.

FIG. 1 shows an example of a slotted array with curved SIW waveguide sections in-between the slots (i.e., the semicircular radiating elements in between the sections which curve in one direction and the sections which curve in the other direction). In the FIG. 1 substrate the width of the curved waveguide and the distance between slots is approximately the same (e.g., approximately 6 mm, in an SIW that has length and width dimensions of 50 mm and 24 mm, respectively). In the FIG. 1 design, phase shifters are not shown. While a goal of this invention is to eliminate phase shifters, it is possible to put phase shifting elements in the curved sections between port 1 and port 2 to realize the desired phase taper for beam scanning without increasing the separation distance between the slots beyond the permissible limit (exceeding this would introduce undesirable grating lobes).

Figure 2:
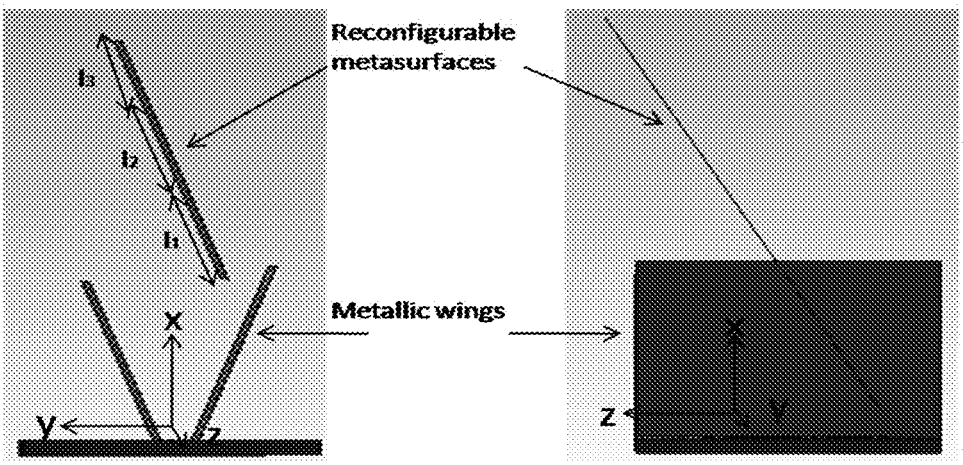
FIG. 2 includes a front and a side view of a superstrate for the SIW waveguide, respectively in left and right panels, which includes two wing structures and a reconfigurable metasurface therebetween.

The embodiment shown in the different drawings of FIG. 2 includes front and side views of a superstrate for the SIW respectively in the left and right panels where the three dimensional character using x, y, and z axes. There are two wing structures (tilted side panels) which extend outwardly with respect to each other as they project from the surface of the SIW to form a horn feature, which, as well be discussed below, enhances the gain. The metallic wings touch the top metallic layer of the SIW; hence, they are relatively easy to fabricate. A reconfigurable meta surface (tilt panel) extends at an angle between the two wing structures. If required, the reconfigurable metasurface may be attached to the top of the wings for support. In the FIG. 2 design, the length of the reconfigurable metasurface can be varied (see lengths l1, l2, l3). For the embodiment in FIG. 2, we used one tilt panel. Referring to both FIGS. 2 and 3, by changing the PIN diodes state between OFF and ON, the panel length can be effectively changed, and this results in changes in the beam direction. As noted above, incident electromagnetic waves transmit through the PIN diodes that are OFF, but are reflected by the PIN diodes (FIG. 3) that are ON.

Figure 4:
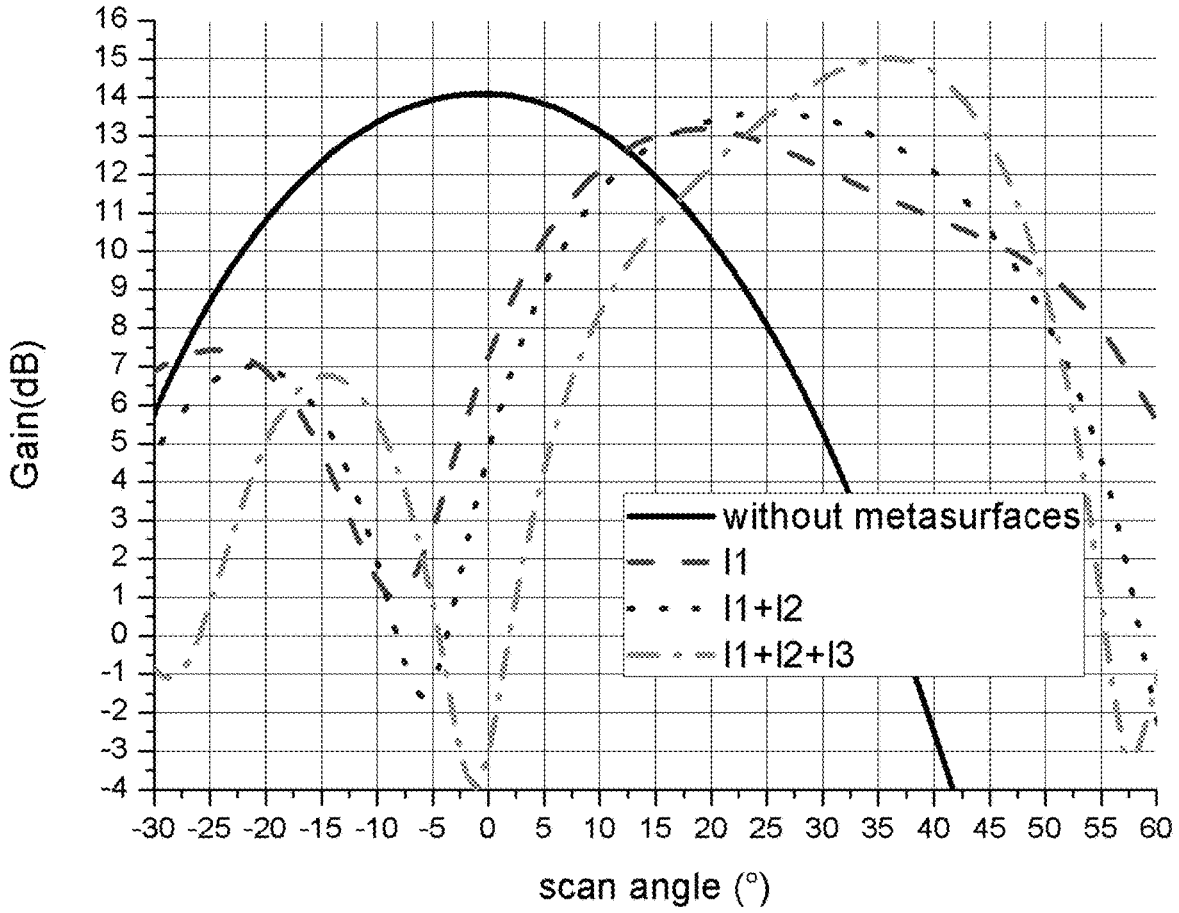
FIG. 4 is a graph showing scanning performance in the transversal-plane for the design shown in FIG. 2.

FIG. 4, which is a plot of the gain in dB versus scan angle in ° when no metasurfaces are employed and when one to three (l1, l2, and l3) metasurfaces are employed, shows simulated transverse-plane patterns of the scanning array depicted in FIG. 2, while operating at 26 GHz, which were generated with commercial software of CST. From FIG. 4, it can be observed that the pointing angle of the peak gain of the array shifts as the length of the panel is varied. Thus, the simulated results demonstrate that the beam scanning performance with the variable-length superstrate configuration shown by example in FIG. 2 is good.

Figure 5:
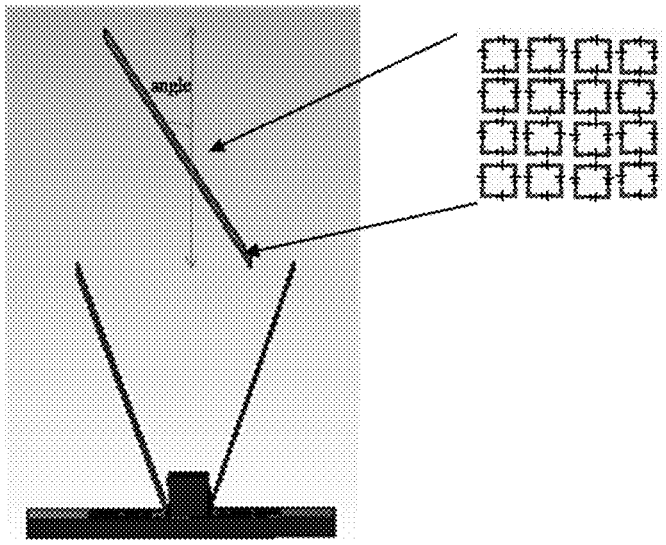
FIG. 5 is a schematic showing an SIW array antenna with a reconfigurable metasurface panel whose tilt angle can be varied.

FIG. 5 illustrates an alternative strategy to realize beam scanning that can be used with or without phase shifters. Specifically, FIG. 5 shows an SIW array antenna with a reconfigurable metasurface panel whose tilt angle can be varied. Beam scanning is realized by using switchable PIN diodes to change the tilt angle of the panel. Specifically, in the FIG. 5 design, we used many panels with different tilt angles, and by making the PIN diode state ON for one panel at a time. For example, the incident electromagnetic waves are transmitted through the PIN diodes that are OFF on the panels at undesired tilt angles, and are reflected by the PIN diodes that are ON in the panel that is at the desired tilt angle.

Figure 6:
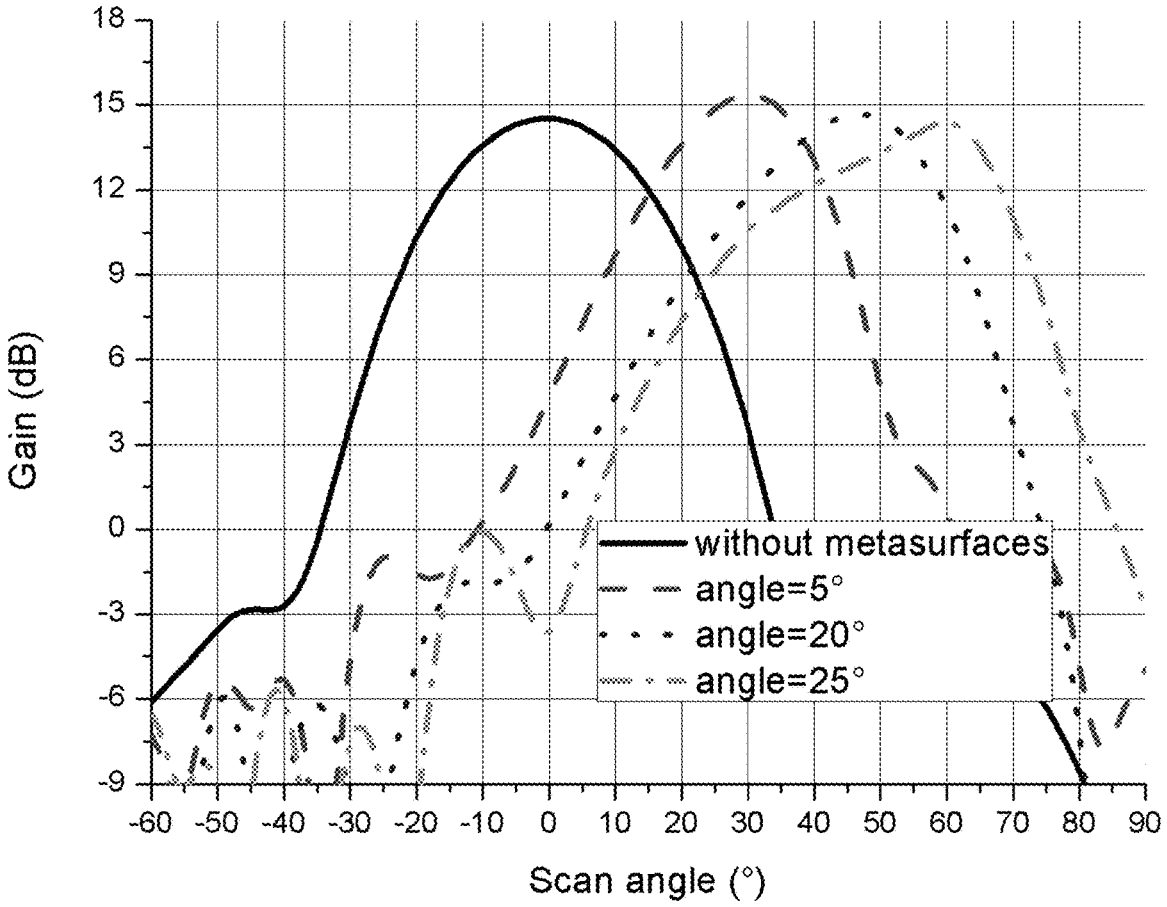
FIG. 6 is a graph showing the scan performance in the transversal-plane for the design shown in FIG. 5.

FIG. 6, which is a plot of the gain in dB versus scan angle in ° when no metasurfaces are employed and when metasurfaces are present and tilted at angles equal 5°, 20°, and 25°, shows simulated patterns for the scanning array depicted in FIG. 5, while operating at 26 GHz. The black line is the reference case which shows the pattern in the absence of a superstrate (such as that depicted in FIG. 5), while the other three lines (red, blue and green) correspond to different tilt angles of the superstrate metasurface panel. As can be seen from FIG. 6, varying the tilt angle of the superstrate metasurface panel provides for good wide-angle beam scanning performance without the use of phase shifters, and maintains the gain level quite well, even when the scan angle is 60°.

Figure 7:
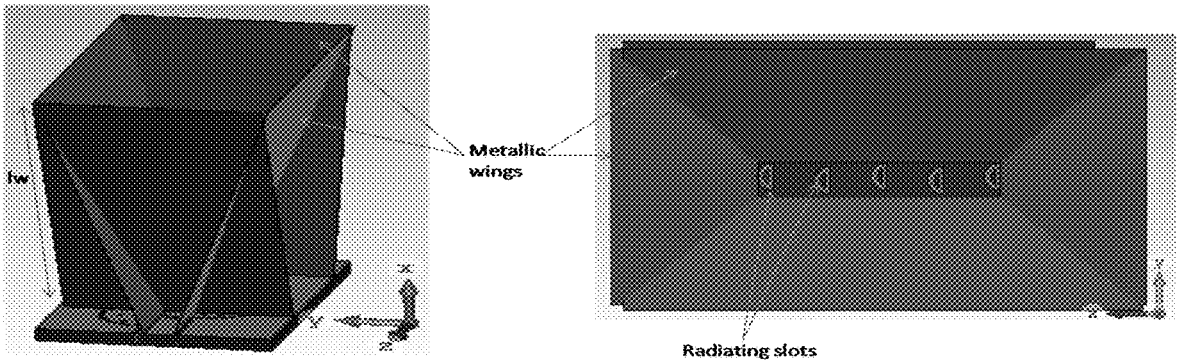
FIG. 7 shows the geometry of four wings used for gain enhancement in a superstrate.

FIG. 7 shows a configuration for further enhancing the gain of the array antenna using two additional wings above the array to form a horn-like configuration. FIG. 7 shows the three dimensional character using x, y, and z axes. Notably, the radiating elements or slots are positioned in the opening between a first pair of wings, and a second opening between a second pair of wings which are perpendicularly oriented to the first pair of wings. The metallic wings which have a side dimension lw touch the top metallic layer of the SIW and are easily fabricated. In FIG. 7, the design is illustrates enhancement of the gain, not scanning of the beam. Thus, the reconfigurable metasurface is not depicted. However, in some embodiments where beam scanning and gain enhancement are desired the features of FIG. 7 may be used in combination with the designs depicted in FIG. 2 or 5.

Table I presents simulated results with the commercial software CST. With reference to Table I, the gain varies as the lengths of the wings and the number of wings is changed. A user can use this Table to determine the number of wings and their lengths to realize the desired performance, subject to height profile limitations, of course. Table 1 shows, for example, that the 4-wing combination, each with a length of 100 mm, is a good choice for the wing configuration.

TABLE I

GAIN VARIATION WITH WING LENGTH AT 26 GHz

| Design | Wings length lw (mm) | Dimensions(x,y,z) (mm) | Gain (dB) |
|---|---|---|---|
| Slotted SIW without wings | — | 9 * 24 * 50 | 12.3 |
| Slotted SIW + 2 wings | 40 | 38 * 24 * 50 | 14.5 |
| Slotted SIW + 4 wings | 40 | 38 * 24 * 50 | 17.4 |
| Slotted SIW + 4 wings | 60 | 58 * 30 * 57 | 19 |
| Slotted SIW + 4 wings | 100 | 96 * 60 * 77 | 22.2 |
| Slotted SIW + 4 wings | 150 | 148 * 80 * 104 | 23.8 |
| Slotted SIW + 4 wings | 200 | 196 * 100 * 130 | 24.1 |

Figure 8A:
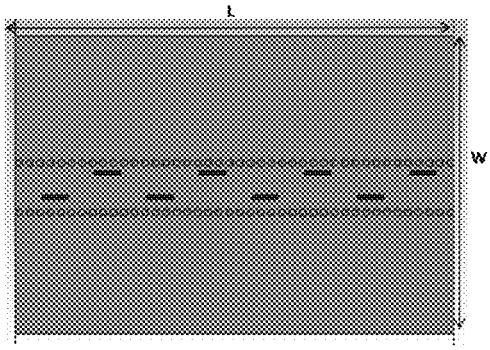
PRIOR ART FIGURE 8A
FIGS. 8A and 8B are schematics of a conventional slotted straight SIW and a slotted curved SIW.
Figure 8B:
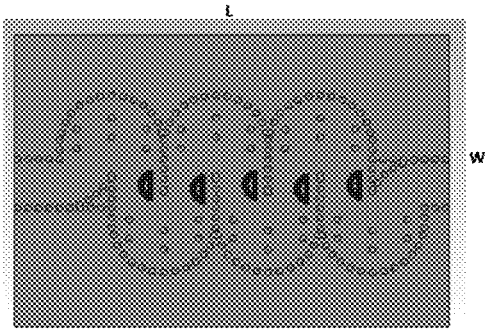
PRIOR ART FIGURE 8B
Figure 9A:
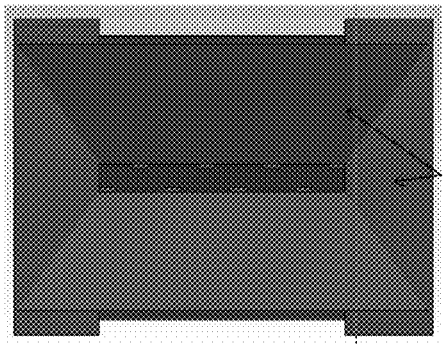
FIGS. 9A and 9B are schematics showing the straight SIW and curved SIW with a horn like structure above each.
Figure 9B:
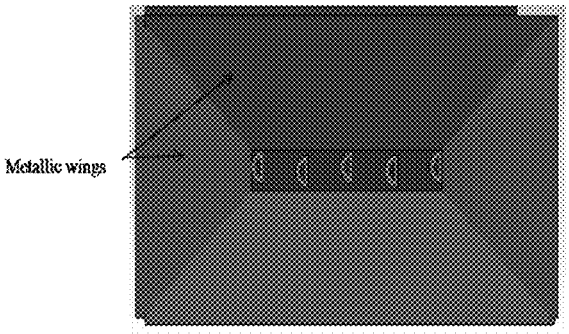

The performances of straight SIW (conventional) and the curved SIW array structures, such as is shown in FIG. 1, were compared. The two designs are shown in FIGS. 8A (classical slotted SIW) and 8B (SIW with curved section between consecutive slots—phase shifters may be employed in the curved sections). The two designs have the same overall length, though their wave paths are different. However, the separation distance between consecutive slots is still the same in the two designs, which is close to one-half wavelength. As with SIWs, the substrates have length, width, and height dimensions, with a wave entry port on a first end of the substrate and a wave exit port on a second end of the substrate wherein the first and second ends are on opposite ends of the substrate. The waveguide extends through the substrate from the wave entry port to the wave exit port, and there are a plurality of spaced apart radiating elements which extend within the waveguide of the substrate. The designs of FIGS. 8A and 8B, which have length L and width W dimensions, are particularly useful in millimeter wave applications. FIGS. 9A and 9B shows the straight and curved slotted SIW arrays with four metallic wings that have been attached to the array to enhance their gain values.

Table II presents a comparison between the straight and curved SIW arrays. The two designs have nearly the same total gain for all cases, while they have a significant difference, on the order of 3.5 dB, for the two winged designs in terms of realized gain. Since the geometrical dimensions of the designs are comparable, the curved design shown in FIG. 9B, which achieves a higher realized gain, is the preferred choice for the array configuration, with or without the scan capability realized by using reconfigurable metasurfaces.

TABLE II

STRAIGHT AND CURVED SIW PERFORMANCE

| | Total gain (dB) | | Realized gain (dB) | |
|---|---|---|---|---|
| Design | Straight SIW | Curved SIW | Straight SIW | Curved SIW |
| Slotted SIW | 11.1 | 11.1 | 2.18 | 5.22 |
| Slotted SIW + dielectric | 12.8 | 13.4 | 6.73 | 12.3 |
| Slotted SIW + dielc + 4 wings | 19.8 | 20 | 15.6 | 19.1 |

The invention claimed is:

1. A substrate integrated waveguide (SIW) for millimeter wave applications, comprising:

a substrate having length, width, and height dimensions;

a wave entry port on a first end of the substrate and a wave exit port on a second end of the substrate, wherein the first and second ends are opposite ends of the substrate;

a waveguide extending through the substrate from the wave entry port to the wave exit port;

a plurality of spaced apart radiating elements which extend within the waveguide of the substrate;

a superstrate positioned above the substrate;

a first pair of wings which angularly extend from the substrate upward into the superstrate, wherein the first pair of wings are spaced apart by a spacing, and wherein the plurality of radiating elements are positioned in said spacing; and a reconfigurable metasurface configured for providing beam scanning capability positioned in or forming the superstrate between and above the spacing of the first pair of wings and at an angle relative to a top surface of the substrate, wherein the SIW comprises at least one of a length and/or width of the reconfigurable metasurface is variable, the angle of the reconfigurable metasurface is variable relative to the top surface of the substrate, and a second pair of wings angularly extending from the substrate upward into the superstrate, wherein the second pair of wings are spaced apart by a second spacing, wherein the plurality of radiating elements are also positioned in the second spacing, and wherein the first pair of wings and the second pair of wings are at right angles to one another and together form a horn above the plurality of spaced apart radiating elements.

2. The SIW of claim 1 wherein the SIW comprises the reconfigurable metasurface.

3. The SIW of claim 2 wherein the length and/or width of the reconfigurable meta surface is varied using an array of PIN diodes which are selectively turned ON or OFF to control transmissivity or reflectance of electromagnetic waves.

4. The SIW of claim 2 wherein the angle of the reconfigurable meta surface is varied using a plurality of tilted panels, each tilted panel having with an array of PIN diodes which are selectively turned ON or OFF to control transmissivity or reflectance of electromagnetic waves.

5. The SIW of claim 1 wherein the waveguide comprises a plurality of curved sections and which passes through the substrate from the wave entry port to the wave exit port, wherein the plurality of curved sections forms a serpentine path of curves in a first direction followed by curves in a second direction which is opposite the first direction, and wherein the plurality of spaced apart radiating elements are positioned between curves in the first direction and curves in the second direction.

6. The SIW of claim 1 wherein the first and second pair of wings have a length of approximately 100 mm.

7. The SIW of claim 1 wherein the first and second pair of wings are metallic.

* * * * *